United States Patent [19]

Füglistaller et al.

[11] Patent Number: 4,838,783

[45] Date of Patent: Jun. 13, 1989

[54] DUAL BURNER FACILITY WITH A FUEL OIL ATOMIZER

[75] Inventors: Cornel Füglistaller, Jonen; Jakob Keller, Dottikon; Thomas Sattelmayer, Mandach, all of Switzerland

[73] Assignee: BBC Brown Boveri AG, Baden, Switzerland

[21] Appl. No.: 184,365

[22] Filed: Apr. 21, 1988

[30] Foreign Application Priority Data

Apr. 30, 1987 [DE] Fed. Rep. of Germany ..... 3714408

[51] Int. Cl.[4] ..... F23Q 9/00

[52] U.S. Cl. ..... 431/284; 431/187; 239/432

[58] Field of Search ..... 431/187, 284; 239/432, 239/416.5, 552, 427

[56] References Cited

U.S. PATENT DOCUMENTS

| | | | |
|---|---|---|---|
| 3,147,795 | 9/1964 | Livingston et al. | 431/284 |
| 3,691,765 | 9/1972 | Carlisle | 239/432 |
| 3,822,654 | 7/1974 | Ghelfi | 431/284 |
| 3,929,290 | 12/1975 | Tallarovic | 239/432 |
| 4,018,554 | 4/1977 | Teodorescu et al. | 239/432 |
| 4,098,255 | 7/1978 | Nowak et al. | 431/284 |
| 4,375,954 | 3/1983 | Trudel | 431/284 |

FOREIGN PATENT DOCUMENTS

| | | |
|---|---|---|
| 463677 | 11/1968 | Switzerland . |
| 1151620 | 5/1969 | United Kingdom . |

*Primary Examiner*—Albert J. Makay
*Assistant Examiner*—Denise L. Ferensic
*Attorney, Agent, or Firm*—Burns, Doane, Swecker & Mathis

[57] ABSTRACT

The resonance atomizer (4) of the burner facility has, as main components, a resonator ring (16) and a resonator cone (23), which each have an annular groove (25+24, respectively), which together form a resonance chamber (24+25). By a plurality of spacer strips (26) on the resonator ring (16), the resonator ring (16) and the resonator cone (23) are held apart by a distance which creates an annular inflow duct (27) for the oil/atomizing air mixture and outflow ducts (28) on the combustion space side for this mixture atomized in the resonance chamber (24+25). Between the components (16, 23) forming the resonator chamber (24+25) and the oil nozzle (7) there is an atomizing cross (17) with a baffle plate (19).

2 Claims, 1 Drawing Sheet

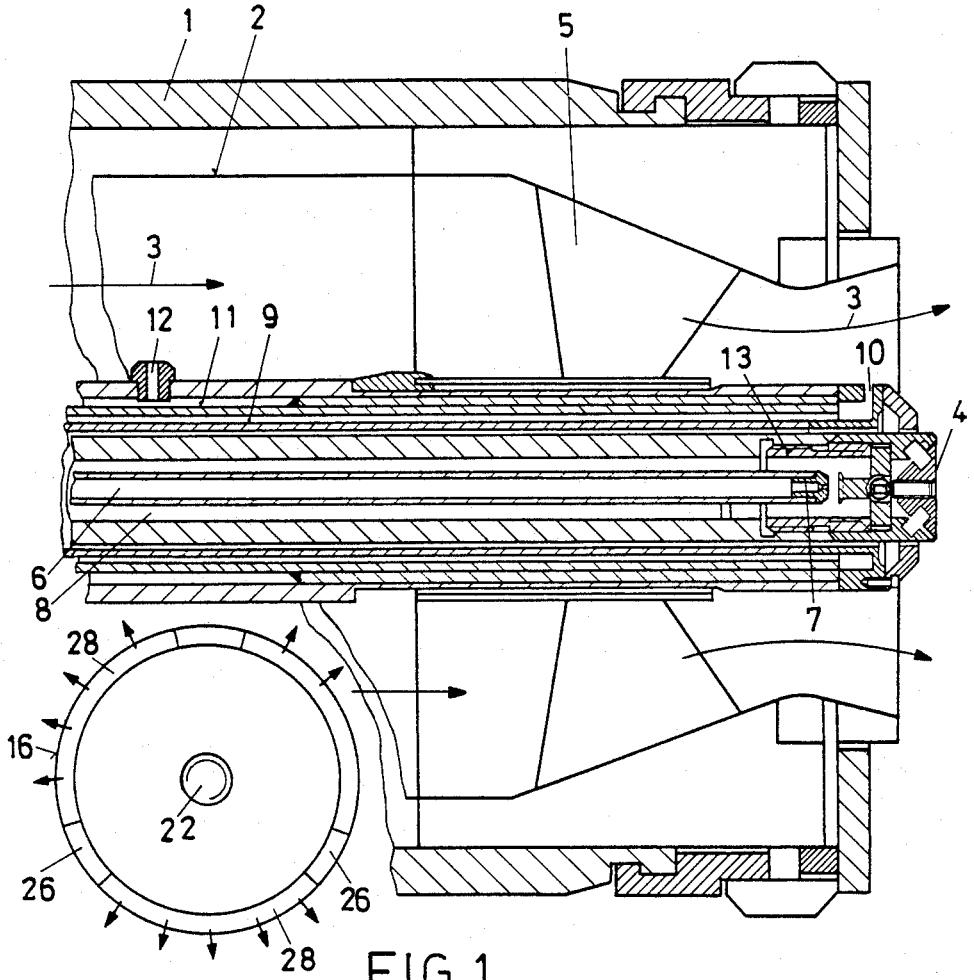
FIG.1
FIG.4
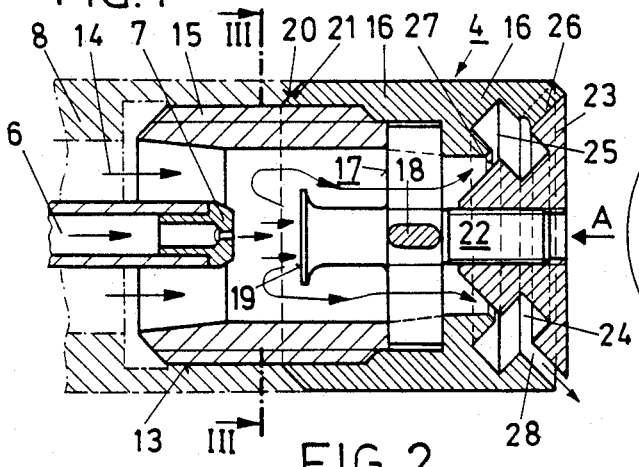
FIG.2
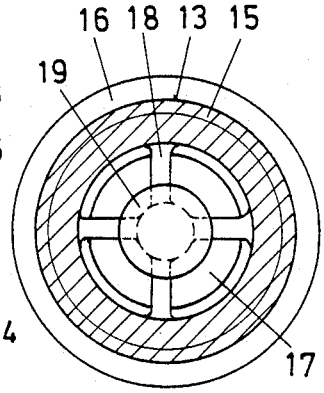
FIG.3

DUAL BURNER FACILITY WITH A FUEL OIL ATOMIZER

BACKGROUND OF THE INVENTION

1. Field of the Invention

The present invention relates to a dual burner facility with a fuel oil atomizer, in which a combustion air duct, a premix gas line with premix gas nozzles, a diffusion gas line with diffusion gas nozzles, an atomizing air line, which opens out into an intake funnel of the atomizer, and an oil supply line with an oil nozzle are arranged coaxially with respect to one another inside a burner casing, the oil nozzle likewise opening out into the intake funnel and the latter having an external thread, which is used for connection to the atomizing air line and to receive a part of the atomizer casing.

2. Discussion of Background

In order to be able to burn the fuel oil, with as little pollution as possible, in dual burner facilities for industrial purposes, for example for the generation of steam for heating plants, process plants or power plants it is necessary to atomize the oil as finely as possible. The requirements in this respect are met only unsatisfactorily by known burner facilities. A good fuel atomization means that the average droplet size required for a good combustion forms the greatest possible proportion in the overall spectrum of droplet sizes.

SUMMARY OF THE INVENTION

The present invention arose from the object of realizing an improvement in the degree of atomozation of the liquid fuel which can be attained in a burner facility, in particular in dual burners with gas and oil as fuels, with the currently customary burner apparatus. Such an improved burner facility was intended to achieve an atomization which is as fine, uniform and complete as possible in order to obtain an extremely low-pollutant, in particular soot-free combustion in a combustion chamber or other combustion space downstream of the burner facility. For this purpose, the interior of a nozzle body, from which the liquid fuel mixed with the atomizer air, hereinafter referred to for short as fuel oil or oil, is injected into a combustion chamber or a combustion space, was to be designed as a resonant chamber in which strong, high-frequency pressure pulsations occur, which considerably intensity the liquid disintegration during discharge of the two-phase fuel oil/air mixture into the combustion space. In fact, measurements have shown that the average droplet size in such a burner facility was 50–70% smaller than that measured on two comparable burners of the known type.

The dual burner facility according to the invention is defined in that the fuel oil atomizer is designed as a resonance atomizer, with a resonator ring, which has an annular groove on a hollow cone surface, and with a resonator cone, which has an annular groove on an outer cone surface, which two annular grooves bound a resonance chamber, which communicates via an annular inflow duct with a hollow space on the oil nozzle side and via outflow ducts with a combustion space downstream of the burner facility, and in that a baffle plate is arranged in extension of the oil nozzle.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 shows an axial longitudinal section through the end portion of the nozzle side of a burner facility according to the invention, FIG. 2 shows the resonance atomizer in an axial longitudinal sections FIG. 3 shows a cross-section through the resonance atomizer according to the sectional line III—III of FIG. 2, and FIG. 4 shows a view of the end face of the resonance atomizer according to the direction of projection A entered in FIG. 2.

DESCRIPTION OF THE PREFERRED EMBODIMENT

Referring now to the drawings, wherein like reference numeral designate identical or corresponding parts throughout the several views, in FIG. 1 the head of a burner facility for dual operation with fuel oil and gas is shown, to the extent necessary for an understanding of the invention. A burner casing 1 receives the elements for the feeding of the combustion air and of the atomizing air, of the fuel gas and of the fuel oil as well as the oil nozzle and the resonance atomizer. Within the casing 1 there is a combustion air duct 2, which is coaxial to the casing axis and tapered at its mouth to an annular nozzle surrounding the resonance atomizer 4. The flow arrows 3 symbolize the combustion air. Likewise coaxial to the casing axis are four ducts, the outer tube wall of the outermost duct being supported against the wall of the combustion air duct 2 by a plurality of supporting ribs 5 arranged around the circumference at an equal angular distance apart. The innermost duct is an oil supply line 6, which ends in the burner head in an oil nozzle 7. The oil supply line 6 is surrounded by an atomizing air line 8, which is followed by a diffusion gas line 9, from which diffusion gas flows out through a multiplicity of diffusion gas nozzles 10, distributed around the circumference, to the mouth region of the combustion air duct 2. In this region, in part-load operation, the arriving combustion air is already mixed with premix gas, which is discharged from a radially outermost premix gas line 11 through a series of premix gas nozzles 12, distributed around the circumference, into the combustion air duct 2. In full-load operation, only premix gas is fed to the combustion air, during idling, ignition of the burner and in the lower start-up range, only diffusion gas is discharged into the combustion air flow. In transitional ranges, both nozzles supply proportions of gas corresponding to the respective requirement.

The design described thus far is to be found with conventional fuel oil atomizers in known burner facilities. The additional inventive element in the case of the burner facility which is the subject concerned is the resonance atomizer 4 shown on its own in FIGS. 2 to 4 on a larger scale than in FIG. 1. It has an intake funnel for the atomizing air symbolized by the flow arrows 14. This intake funnel is provided with an external thread 15, by means of which, as revealed by FIG. 1, in the assembled state of the resonance atomizer it is screwed into the atomizing air line 8. This line 8 is drawn in dot-dash lines in FIG. 2. With screwed-in resonance atomizer 4, a resonator ring 16, which is screwed onto the external thread 15 and thereby clamps an atomizer cross 17 having, for example, four radial arms 18 and a baffle plate 19, is braced with an outside cone bevel 20 against a corresponding inner cone surface 21 of the atomizing air line 8. On the opposite side of the baffle plate 19, the atomizer cross 17 has a threaded stem 22, onto which a resonator cone 23 is screwed.

This resonator cone and the resonator ring 16 are provided with annular grooves 24 and 25, respectively, which, in the assembled state, form a resonance chamber of essentially rectangular cross-section. The resonator ring 16 has at the outer end of its inner cone, i.e. outside the annular groove 25, three spacer strips 26, evenly distributed around the circumference and of the width shown in FIG. 4, on which the resonator cone 23 rests, as a result of which, on the side of the resonance chamber 24+25 facing the atomizer cross 17, an annular inflow duct 27 is bound, extending around the entire circumference, and on the opposite side, due to the interruption by the three spacer strips 26, three arcuate outflow ducts 28 are bound.

The fuel oil discharged from the oil nozzle 7 hits the baffle plate 19 and is distributed over the circumference of the latter. An oil film is formed at the rim of the plate and enters the atomizing air flowing coaxially around the oil supply line 6. The oil film is broken and, after the atomizer cross 17, the oil/air mixture passes via the inflow channel 27 into the resonance chamber 24+25, in which strong high-frequency pressure pulsations of the air/fuel oil mixture occur, which considerably intersify the liquid disintegration during the discharge of the mixture from the three outflow ducts 28. In FIG. 4, the mixture discharged from the ducts 28 is indicated by radial arrows. The spacer strips 26, as resistances, contribute additionally to the turbulence in the combustion space, part of the discharged mixture being deflected laterally.

In comparison with atomization without resonator, this design produces a far better atomization with the same provisions for providing the atomizer air. Compared with the results of measurements on two relatively large known atomizer types designed for the same burner output, measurements on the atomizer according to the invention showed a reduction in the average droplet size of up to 50%.

Obviously, numerous modifications and variatoins of the present invention are possible in the light of the above teachings. It is therefore to be understood that within the scope of the appended claims, the invention may be practiced otherwise than as specifically described herein.

What is claimed as new and desired to be secured by letters patent of the United States is:

1. A dual burner facility with a fuel oil atomizer, in which a combustion air duct, a premix gas line with premix gas nozzles, a diffusion gas line with diffusion gas nozzles, an atomizing air line which opens out into an intake funnel of the oil atomizer, and an oil supply line with an oil nozzle are arranged coaxially with respect to one another inside a burner casing;

the oil nozzle opens into the intake funnel, which intake funnel has an external thread that is used for connecting the intake funnel to the atomizing air line;

a resonance atomizer mounted to the external thread of the intake funnel, said resonance atomizer comprises a resonator ring, which resonator ring has an annular groove on a hollow cone surface, and a resonator cone, which has an annular groove on an outer cone surface, said resonator cone fits within said hollow cone surface such that the two annular grooves form a resonance chamber, which chamber communicates via an annular inflow duct with a hollow space on the oil nozzle side and via outflow ducts with a combustion space downstream of the burner facility, and wherein a baffle plate is arranged in an extension of the oil nozzle.

2. A burner facility as claimed in claim 1, wherein the resonator ring is designed as a casing part which can be screwed onto the external thread of the intake funnel and clamps the annular circumference of an atomizer cross between itself and the intake funnel, which atomizer cross has a hub with the said baffle plate and a threaded stem, onto which the resonator cone is screwed, wherein the hub of the atomizer cross is connected by arms to its circumference, and in that the resonator ring is provided on the outer rim of its hollow cone surface with spacer strips, which hold the resonator cone at a distance away from the resonator ring, by which the inflow duct and the outflow duct are formed.

* * * * *